US009754548B2

(12) United States Patent
Park

(10) Patent No.: US 9,754,548 B2
(45) Date of Patent: Sep. 5, 2017

(54) DISPLAY DEVICE WITH CONTROLLABLE OUTPUT TIMING OF DATA VOLTAGE IN RESPONSE TO GATE VOLTAGE

(71) Applicant: Samsung Display Co., LTD., Yongin, Gyeonggi-Do (KR)

(72) Inventor: Sang Wook Park, Seongnam-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 30 days.

(21) Appl. No.: 14/792,926

(22) Filed: Jul. 7, 2015

(65) Prior Publication Data

US 2016/0049127 A1 Feb. 18, 2016

(30) Foreign Application Priority Data

Aug. 12, 2014 (KR) ..... 10-2014-0104560

(51) Int. Cl.
*G09G 3/36* (2006.01)

(52) U.S. Cl.
CPC ..... *G09G 3/3688* (2013.01); *G09G 3/3655* (2013.01); *G09G 3/3696* (2013.01); *G09G 2310/08* (2013.01); *G09G 2320/0223* (2013.01); *G09G 2320/0276* (2013.01); *G09G 2320/041* (2013.01)

(58) Field of Classification Search
CPC ... G09G 2320/0223; G09G 2320/0276; G09G 2320/041
USPC ..... 345/100
See application file for complete search history.

(56) References Cited

U.S. PATENT DOCUMENTS

| | | | | |
|---|---|---|---|---|
| 5,995,074 | A | 11/1999 | Kusafuka et al. | |
| 6,441,562 | B1 | 8/2002 | Kim | |
| 8,248,398 | B2 | 8/2012 | Cho et al. | |
| 8,274,467 | B2 | 9/2012 | Qi et al. | |
| 8,330,748 | B2 | 12/2012 | Sagano | |
| 2007/0120780 | A1* | 5/2007 | Park | G09G 3/3291 345/76 |
| 2011/0012822 | A1* | 1/2011 | Park | G09G 3/3614 345/99 |
| 2011/0205206 | A1* | 8/2011 | Yoo | G09G 3/3275 345/211 |
| 2012/0320098 | A1* | 12/2012 | Kwak | G09G 3/2003 345/690 |
| 2013/0235011 | A1 | 9/2013 | Lin et al. | |
| 2015/0054724 | A1* | 2/2015 | Wang | G09G 3/3648 345/98 |

(Continued)

FOREIGN PATENT DOCUMENTS

| | | |
|---|---|---|
| JP | 2009253876 A | 10/2009 |
| JP | 2015082063 | 4/2015 |

(Continued)

*Primary Examiner* — Chanh Nguyen
*Assistant Examiner* — Daniel Duong
(74) *Attorney, Agent, or Firm* — Cantor Colburn LLP

(57) ABSTRACT

A display device includes a display panel including pixels, gate lines electrically connected to the pixels, and data lines electrically connected to the pixels, a gate driver which sequentially outputs gate voltages to the gate lines, and a data driver which receives at least a portion of the gate voltages from the display panel as a feedback voltage, determines an output timing of data voltages based on the feedback voltage, and outputs the data voltages to the data lines based on the output timing.

10 Claims, 7 Drawing Sheets

(56) References Cited

U.S. PATENT DOCUMENTS

2016/0118006 A1* 4/2016 Park ..... G09G 3/3666
345/690

FOREIGN PATENT DOCUMENTS

KR 1020080040952 A 5/2008
KR 1020130024719 A 3/2013

* cited by examiner

DISPLAY DEVICE WITH CONTROLLABLE OUTPUT TIMING OF DATA VOLTAGE IN RESPONSE TO GATE VOLTAGE

This application claims priority to Korean Patent Application No. 10-2014-0104560, filed on Aug. 12, 2014, and all the benefits accruing therefrom under 35 U.S.C. §119, the content of which in its entirety is herein incorporated by reference.

BACKGROUND

1. Field

The disclosure relates to a display device. More particularly, the disclosure relates to a display device that controls an output timing of a data voltage in real time based on a gate voltage that may be varied while the display device is in use.

2. Description of the Related Art

Recently, various display devices, such as a liquid crystal display device, a plasma display device, an organic light emitting display device, etc., have been wised used to display image information. The display device typically includes pixels arranged in a matrix form, and each pixel includes a switching transistor and a display element.

When a gate voltage is applied to each pixel through a gate line, the switching transistor is turned on. Then, in synchronization with the turned-on switching transistor, a data voltage is applied to the element through a data line, and thus the display element is operated to display an image.

SUMMARY

The disclosure provides a display device that controls an output timing of a data voltage in response to a gate voltage.

Embodiments of the invention provide a display device including a display panel including a plurality of pixels, a plurality of gate lines electrically connected to the pixels, and a plurality of data lines electrically connected to the pixels, a gate driver sequentially which applies gate voltages to the gate lines, and a data driver which receives at least a portion of the gate voltages as a feedback voltage, determines an output timing of data voltages based on the feedback voltage, and outputs the data voltages to the data lines based on the output timing.

In an embodiment, the display device may further include a feedback line connected to at least one gate line of the gate lines to apply the feedback voltage to the data driver.

In an embodiment, the gate lines may include first to m-th gate lines arranged in a scan direction, and the feedback line may be connected to the m-th gate line.

In an embodiment, the feedback line may include a plurality of feedback lines, the feedback lines may be connected to different gate lines of the gate lines, respectively, a plurality of different feedback voltages may be applied to the data driver through the feedback lines, and the data driver may control the output timing of the data voltages to every corresponding pixel row connected to the feedback lines through the different gate lines based on the feedback voltages in real time.

In an embodiment, the data driver may include an input part which receives image data signals in a digital form from an outside thereof, a converter which converts the image data signals applied from the input part into the data voltages in an analog form, and an output part which controls the output timing of the data voltages based on the feedback voltage and outputs the data voltages to the display panel.

In an embodiment, the output part may include an operator which receives the feedback voltage and outputs a timing compensation voltage determined based on the feedback voltage and a timing determining part which determines the output timing of the data voltages based on the timing compensation voltage.

In an embodiment, the timing determining part may include an output buffer which receives the data voltages from the converter and buffers the data voltages and a switching part which receives the timing compensation voltage and controls the output timing of the data voltages based on the timing compensation voltage.

In an embodiment, the switching part may include a plurality of switching devices connected to the data lines, respectively.

In an embodiment, the operator may receive at least one data voltage of the data voltages output from the output buffer, and the operator may operate the data voltage and the feedback voltage to generate the timing compensation voltage.

In an embodiment, the operator may include an integrating amplifier circuit.

In an embodiment, the operator may receive an output start signal from an outside thereof and output the output start signal compensated to correspond to the feedback voltage as the timing compensation voltage, and the timing determining part may output the data voltages to the display panel based on the timing compensation voltage.

According to exemplary embodiments herein, the data driver receives the gate voltage as the feedback voltage to sense a variation of the gate voltages in the display panel. In such embodiments, the data driver controls the output timing of the data voltages based on the variation of the gate voltages. Therefore, exemplary embodiments of the display device may correspond to the variation of the gate voltages in real time and improve display quality thereof by effectively preventing defects in display quality caused by the difference in timing between the gate voltages and the data voltages.

In such embodiments, the display device may effectively prevent the gate voltage from being delayed even though the temperature of the display device increases. Thus, the display device may control to improve display quality in real time by effectively preventing defects cause by temperature change while the display device is in use, and thus the display device may have improved reliability.

BRIEF DESCRIPTION OF THE DRAWINGS

The above and other features of the disclosure will become readily apparent by reference to the following detailed description when considered in conjunction with the accompanying drawings, in which.

DETAILED DESCRIPTION

Figure 1:
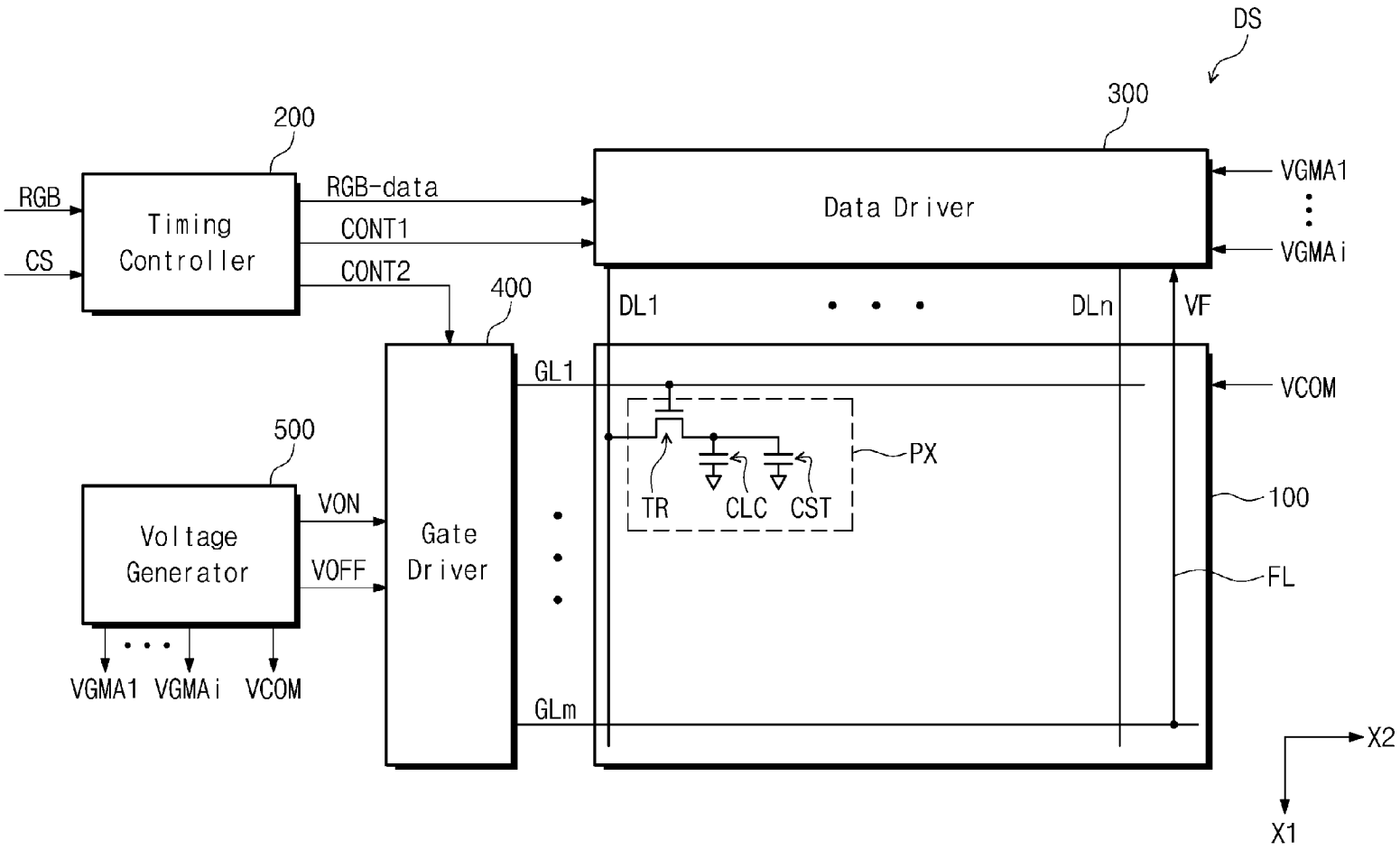
FIG. 1 is a block diagram showing an exemplary embodiment of a display device according to the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. "Or" means "and/or." As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings herein.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms, "a", "an" and "the" are intended to include the plural forms as well, unless the context clearly indicates otherwise. It will be further understood that the terms "comprises" and/or "comprising," or "includes" and/or "including", when used in this specification, specify the presence of stated features, integers, steps, operations, elements, and/or components, but do not preclude the presence or addition of one or more other features, integers, steps, operations, elements, components, and/or groups thereof.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiments of the invention will be explained in detail with reference to the accompanying drawings.

FIG. 1 is a block diagram showing an exemplary embodiment of a display device DS according to the invention.

Referring to FIG. 1, an exemplary embodiment of the display device DS includes a display panel 100, a timing controller 200, a data driver 300, a gate driver 400, and a voltage generator 500.

In an exemplary embodiment, the display panel 100 includes a plurality of data lines DL1 to DLn, a plurality of gate lines GL1 to GLm, and a plurality of pixels electrically connected to the data lines DL1 to DLn and the gate lines GL1 to GLm. Herein, n and m are natural numbers.

In an exemplary embodiment, the display panel 100 receives electric signals to display an image. In an exemplary embodiment, the display panel 100 may include one of various display panels, such as a liquid crystal display panel, an organic light emitting display panel, an electrophoretic display panel, an electrowetting display panel, etc., but not being limited thereto or thereby. Hereinafter, for convenience of description, an exemplary embodiment where the display panel 100 is the liquid crystal display panel will be described in detail.

In an exemplary embodiment, the data lines DL1 to DLn extend in a first direction X1 and are arranged in a second direction X2 crossing the first direction X1. The data lines DL1 to DLn receive data voltages, respectively.

In an exemplary embodiment, the gate lines GL1 to GLm extend in the second direction X2 and are arranged in the first direction X1. The gate lines GL1 to GLm are insulated from the data lines DL1 to DLn while crossing the data lines DL1 to DLn.

The gate lines GL1 to GLm may be sequentially scanned from a first gate line GL1 to an m-th gate line GLm (e.g., a forward driving). The gate lines GL1 to GLm may sequentially receive gate voltages along a scan direction. In an alternative exemplary embodiment of the invention, the gate lines GL1 to GLm may be sequentially scanned from the m-th gate line GLm to the first gate line GL1 (e.g., a backward driving).

Each of the pixels is connected to a corresponding gate line of the gate lines GL1 to GLm and a corresponding data line of the data lines DL1 to DLn. The pixels are arranged substantially in a matrix form including pixel columns and pixel rows.

The pixels may have substantially the same structure as each other. In FIG. 1, only one pixel PX of the pixels, which is connected to the first gate line GL1 and a first data line DL1 is shown for convenience of illustration. In an exemplary embodiment, each pixel PX includes a thin film transistor TR, a liquid crystal capacitor CLC, and a storage capacitor CST.

In an exemplary embodiment, the thin film transistor TR includes a control terminal (e.g., a control electrode), an input terminal (e.g., an input electrode), and an output terminal (e.g., an output electrode). The control electrode is connected to the first gate line GL1, the input electrode is connected to the first data line DL1, and the output electrode is connected to the liquid crystal capacitor CLC and the storage capacitor CST.

In an exemplary embodiment, the thin film transistor TR transmits the data voltage applied thereto through the first data line DL1 to a first electrode of the liquid crystal capacitor CLC and a first electrode of the storage capacitor CST in response to the gate voltage applied thereto through the first gate line GL1.

In an exemplary embodiment, the liquid crystal capacitor CLC receives the data voltage through the first electrode thereof and receives a common voltage VCOM, which may be provided from an outside of the display panel 100, through a second electrode thereof, which faces the first electrode of the liquid crystal capacitor CLC. The common voltage VCOM may be provided from the voltage generator 500, which will be described later in greater detail. The liquid crystal capacitor CLC includes a liquid crystal layer (not shown) disposed between the first and second electrodes and is charged based on a difference in voltage between the data voltage and the common voltage VCOM.

In an exemplary embodiment, the storage capacitor CST receives the data voltage through the first electrode thereof and receives a storage voltage through a second electrode thereof, which faces the first electrode of the storage capacitor CST. The storage capacitor CST is connected in parallel to the liquid crystal capacitor CLC to allow the voltage charged in the liquid crystal capacitor CLC to be maintained until a next data voltage is provided.

In an exemplary embodiment, the timing controller 200 receives a first image data RGB and a plurality of control signals CS from an external source (not shown). The control signals CS may include a data enable signal, a horizontal synchronization signal, a vertical synchronization signal, and a clock signal.

In an exemplary embodiment, the timing controller 200 generates a data control signal CONT1 and a gate control signal CONT2 based on the control signals CS. In such an embodiment, the timing controller 200 converts the first image data RGB to a second image data RGB-data in consideration of an operation mode of the display panel 100. The second image data RGB-data and the data control signal CONT1 are applied to the data driver 300, and the gate control signal CONT2 is applied to the gate driver 400.

In an exemplary embodiment, the data control signal CONT1 includes a horizontal start signal for starting an operation of the data driver 300, a polarity control signal for controlling a polarity of the data voltages, and an output start signal for determining an output timing of the data voltages output from the data driver 300. The gate control signal CONT2 includes a vertical start signal for starting an operation of the gate driver 400 and a gate clock signal for determining an output timing of the gate voltages.

In an exemplary embodiment, the data driver 300 drives the data lines DL1 to DLn disposed in the display panel 100. The data driver 300 receives the second image data RGB-data and the data control signal CONT1 from the timing controller 200.

In an exemplary embodiment, the data driver 300 is electrically connected to the data lines DL1 to DLn disposed in the display panel 100 to drive the data lines DL1 to DLn. The data driver 300 converts the second image data RGB-data to the data voltages in response to the data control signal CONT1, and outputs the data voltages to the display panel 100.

In an exemplary embodiment, the data driver 300 converts the second image data RGB-data in a digital form to the data voltages in an analog form based on a plurality of gamma reference voltages VGMA1 to VGMAi provided from the voltage generator 500. Herein, i is a natural number.

The data driver 300 may be disposed adjacent to a first side, e.g., a long side, of the display panel 100. Although not shown in figures, the data driver 300 may be disposed on a separate printed circuit board and electrically connected to the display panel 100 through a flexible film. In an exemplary embodiment, the data driver 300 may include a plurality of driving chips, which is disposed, e.g., mounted, directly on the display panel 100 or disposed on a film attached onto the display panel 100.

The gate driver 400 is electrically connected to the gate lines GL1 to GLm disposed in the display panel 100 to drive the gate lines GL1 to GLm. The gate driver 400 generates the gate voltages in response to the gate control signal CONT2 and sequentially outputs the gate voltages to the gate lines GL1 to GLm.

Each of the gate voltages maintains a level corresponding to a gate-on voltage VON during a predetermined period (hereinafter, referred to as a high period) in a frame period and maintains a level corresponding to a gate-off voltage VOFF during a remaining period in the frame period. Thus, the pixels of the display panel 100 are sequentially operated during the high period in the unit of pixel row.

The gate driver 400 is disposed adjacent to a second side, e.g., a short side, of the display panel 100. The gate driver 400 may include a plurality of chips mounted on a film, which is attached onto the display panel 100.

In an exemplary embodiment, the gate driver 400 may be directly formed on the display panel 100 through a thin film process. In such an embodiment, the gate driver 400 may include a plurality of amorphous silicon transistors or a plurality of oxide semiconductor transistors.

The voltage generator 500 generates the gamma reference voltages VGMA1 to VGMAi to generate the data voltages and provides the gamma reference voltages VGMA1 to VGMAi to the data driver 300. The voltage generator 500 generates the gate-on voltage VON and the gate-off voltage VOFF for driving the display panel 100, and provides the gate-on voltage VON and the gate-off voltage VOFF to the gate driver 400. The voltage generator 500 generates the common voltage VCOM and provides the common voltage VCOM to the display panel 100.

In an exemplary embodiment, the display device DS may further include a feedback line FL. The feedback line FL is disposed in the display panel 100. The feedback line FL is disposed in a third side, e.g., another short side, of the display panel 100 opposite to the second side in which the gate driver 400 is disposed.

The feedback line FL is connected to one gate line of the gate lines GL1 to GLm. In one exemplary embodiment, for example, the feedback line FL may be connected to the m-th gate line GLm as shown in FIG. 1, but not being limited thereto. Hereinafter, for the sake of clarity and ease of understanding, an exemplary embodiment where the m-th gate line GLm connected to the feedback line FL will be mainly described in greater detail, but the invention is not limited thereto.

The feedback line FL may be disposed on the same layer as the gate lines GL1 to GLm, or the feedback line FL may be disposed on the gate lines GL1 to GLm to be insulated from the gate lines GL1 to GLm and electrically connected to a corresponding gate line of the gate lines GL1 to GLm through a contact hole (not shown).

The feedback line FL applies an m-th gate voltage flowing through the m-th gate line GLm to the data driver 300 as a feedback voltage VF. In an exemplary embodiment, the feedback voltage VF applied through the feedback line FL may be generated based on the m-th gate voltage. In such an embodiment, the feedback voltage VF may include delay information about the m-th gate voltage.

The gate voltages may be delayed while passing through the display panel 100. In such an embodiment, the m-th gate voltage includes a peak (hereinafter, referred to as a high period), around which the m-th gate voltage increases to a high voltage level and then is lowered to a low voltage level. In the high period of the delayed m-th gate voltage, a time, during which the m-th gate voltage is increased or decreased to the high voltage level or the low voltage level, becomes longer when compared with a case in which the m-th gate voltage is not delayed.

Due to a degree of delay in a gate voltage, defects in charge of the data voltage applied to a pixel that receives the gate voltage may occur. Accordingly, when a delay occurs in a gate voltage, the pixel that receives the gate voltage may be charged with a voltage lower than a corresponding grayscale value or charged with a data voltage of a next column. As a result, the display panel 100 may display a distorted image thereon.

The degree of delay in each gate voltage may be affected by a position of the gate driver 400, a scan direction of the gate driver 400, and a temperature of the display panel 100. In an exemplary embodiment, the degree of delay in the m-th gate voltage flowing through the m-th gate line GLm may be greater than that of the gate voltage flowing through the first gate line GL1. In such an embodiment, the degree of delay in the m-th gate voltage flowing through the m-th gate line GLm increases as a distance from the gate driver 400 toward a third side (e.g., a right side n FIG. 1) increases.

In an exemplary embodiment, the feedback line FL is connected to an end of the m-th gate line GLm, which is finally scanned, of the gate lines GL1 to GLm. Therefore, in an exemplary embodiment, the feedback line FL may transmit the gate voltage, which has the greatest degree in delay among the gate voltages, to the data driver 300 as the feedback voltage VF. In such an embodiment, the data driver 300 controls the output timing of the data voltages to the display panel 100 in response to the feedback voltage VF.

In an exemplary embodiment, the temperature of the display panel 100 may increase or decrease while the display panel 100 is in use. For instance, when the use time of the display panel 100 is increased after a power of the display device DS is turned on, the temperature of the display panel 100 may increase. In an exemplary embodiment, the data driver 300 receives the feedback voltage VF in real time. Thus, in such an embodiment, the data driver 300 may respond in real time to a variation in the gate voltage, which may be caused by the temperature variation, while the display device DS is in use. The feedback process of the data driver 300 will be described later in greater detail.

Figure 2:
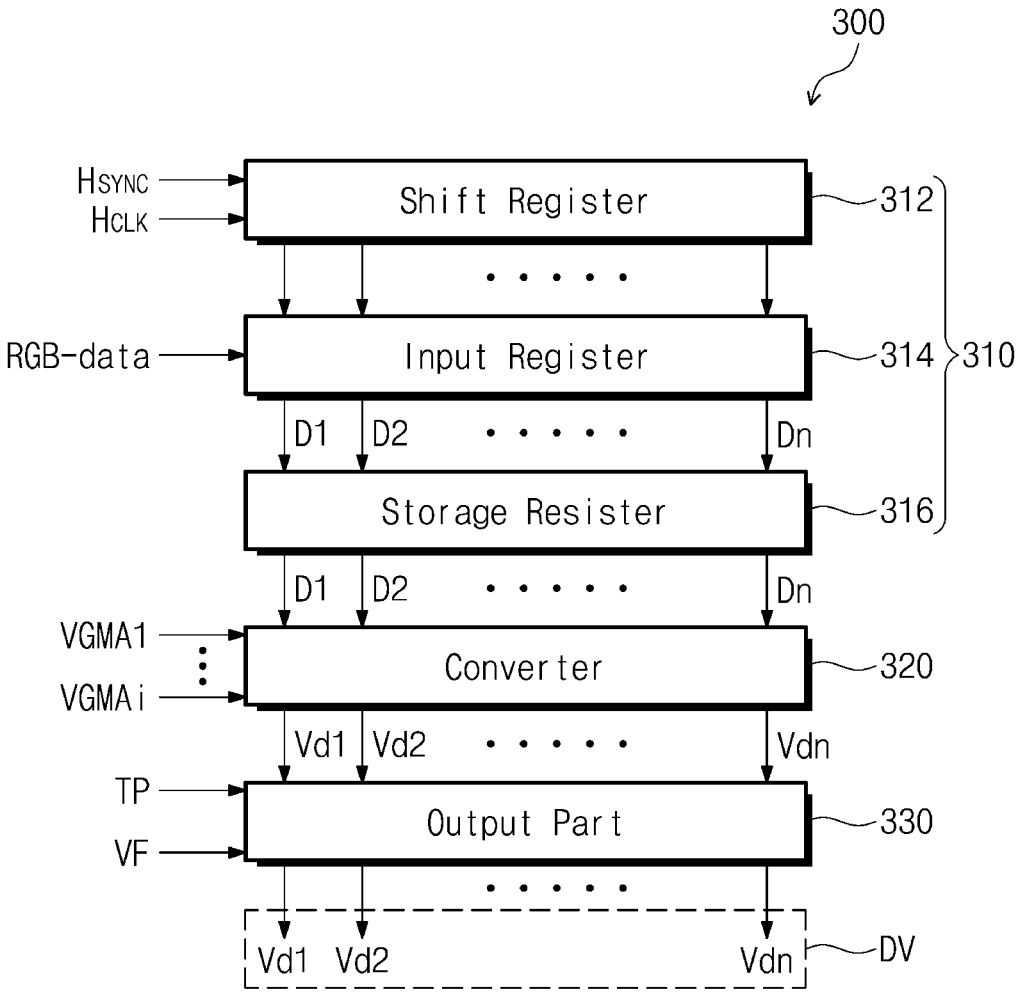
FIG. 2 is a block diagram showing an exemplary embodiment of a data driver according to the invention.

FIG. 2 is a block diagram showing an exemplary embodiment of the data driver 300 according to the invention. An exemplary embodiment of the data driver 300 will hereinafter be described in detail with reference to FIG. 2.

Referring to FIG. 2, an exemplary embodiment of the data driver 300 includes an input part 310, a converter 320 and an output part 330.

The input part 310 receives the second image data RGB-data from the external source. The input part 310 includes a shift register 312, an input register 314, and a storage register 316.

The shift register 312 receives the horizontal synchronization signal $H_{SYNC}$ and a horizontal clock signal $H_{CLK}$ of the first control signal CONT1 (refer to FIG. 1). The shift register 312 starts an operation thereof in response to the horizontal synchronization signal $H_{SYNC}$.

The shift register 312 includes a plurality of stages (not shown) connected to each other in series or in a cascade configuration. The stages are sequentially turned on to sequentially apply a high period of the horizontal clock signal $H_{CLK}$ to the input register 314 as an output signal.

The input register 314 receives the second image data RGB-data in a digital form from the external source. The input register 314 sequentially stores the second image data RGB-data in synchronization with the horizontal clock signal $H_{CLK}$. The input register 314 stores the image data signals D1 to Dn (hereinafter, referred to as first to n-th image data signals) corresponding to one pixel row.

The storage register 316 stores the first to n-th image data signals D1 to Dn, which are substantially simultaneously output from the input register 314. The storage register 316 stores the first to n-th image data signals D1 to Dn during a time period in which the input register 314 outputs the first to n-th image data signals D1 to Dn and sequentially stores image data signals corresponding to a next pixel row.

The converter 320 receives the first to n-th image data signal D1 to Dn from the storage register 316 and receives the gamma reference voltages VGMA1 to VGMAi from the voltage generator 500. The converter 500 converts the first to n-th image data signals D1 to Dn to first to n-th data voltages Vd1 to Vdn in an analog form based on the gamma reference voltages VGMA1 to VGMAi.

The output part 330 receives the output start signal TP of the data control signal CONT1 from the external source, receives the first to n-th data voltages Vd1 to Vdn from the converter 320, and applies the first to n-th data voltages Vd1 to Vdn to the display panel 100 (refer to FIG. 1). The output part 330 outputs the first to n-th data voltages Vd1 to Vdn in response to the output start signal TP.

In an exemplary embodiment, the output part 330 determines an output timing of the first to n-th data voltages Vd1 to Vdn. The output timing means a time point at which the first to n-th data voltages Vd1 to Vdn are output from the data driver 300 to the display panel 100.

The output part 330 receives the feedback voltage VF to determine the output timing. The output part 330 controls the output timing of the first to n-th data voltages Vd1 to Vdn based on the feedback voltage VF and outputs the first to n-th data voltages Vd1 to Vdn to the data lines DL1 to DLn (refer to FIG. 1) disposed in the display panel 100, respectively.

In an exemplary embodiment, the first to n-th data voltages Vd1 to Vdn output from the output part 330 have substantially the same voltage level as that of the first to n-th data voltages Vd1 to Vdn applied to the output part 330, and only the output timing thereof is adjusted. For the convenience of description, the first to n-th data voltages Vd1 to Vdn output from the output part 330 may be referred to as an output voltage DV, and the output timing of the output voltage DV will hereinafter be described in detail.

In an exemplary embodiment, the first to n-th data voltages Vd1 to Vdn are substantially simultaneously output from the output part 330 to the display panel 100. Thus, the output timing of the first data voltage Vd1 among the first to n-th data voltages Vd1 to Vdn will be described as the output timing of the output voltage DV as a representative example. The output timing of the output voltage DV may be equally applied to the data voltages Vd2 to Vdn.

Figure 3:
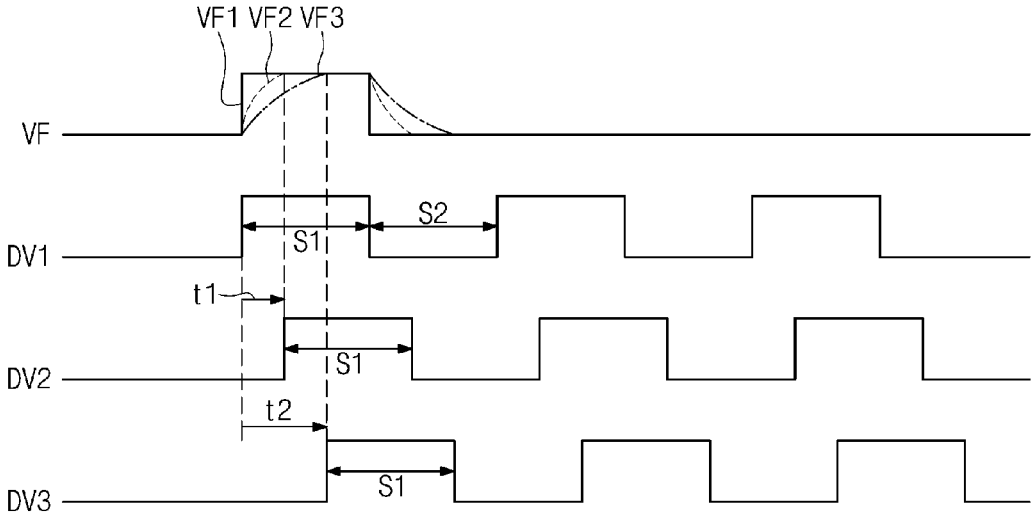
FIG. 3 is a signal timing diagram showing a feedback voltage input to the data driver and an output voltage output from the data driver shown in FIG. 2.

FIG. 3 is a signal timing diagram showing the feedback voltage input to the data driver and the output voltage output from the data driver shown in FIG. 2. The feedback process of the data driver 300 will hereinafter be described in detail with reference to FIG. 3.

Referring to FIG. 3, the output voltage DV (refer to FIG. 2) has an output timing varied (e.g., determined) based on the feedback voltage VF applied to the output part 330. The feedback voltage VF includes a plurality of feedback voltages VF1, VF2, and VF3. FIG. 3 shows timings of the feedback voltages VF1, VF2 and VF3 and a plurality of output voltages DV1, DV2 and DV3, which are output corresponding to the feedback voltages VF1, VF2 and VF3, respectively. The output voltages DV1, DV2 and DV3 may include first, second and third output voltages DV1, DV2 and DV3.

The feedback voltages VF1, VF2 and VF3 may include a first feedback voltage VF1, a second feedback voltage VF2 and a third feedback voltage VF3, which correspond to the gate voltages with different delay degrees. In an exemplary embodiment, the feedback voltages VF1, VF2 and VF3 may be provided from a plurality of feedback lines connected to different gate lines in one frame period. In an alternative exemplary embodiment, the feedback voltages VF1, VF2 and VF3 may be provided from one feedback line, but correspond to the gate voltages with different delay degrees according to a time lapse in different frame periods.

The first feedback voltage VF1 corresponds to a gate voltage having substantially no delay, and the third feedback voltage VF3 corresponds to a gate voltage having a relatively long time delay. The feedback voltages VF1, VF2 and VF3 respectively correspond to the gate voltages, and each of the feedback voltages VF1, VF2 and VF3 has one high period corresponding to the high period of each of the gate voltages.

The output voltages DV1, DV2 and DV3 may be output from the output part 330 at different timings from each other in response to the feedback voltages VF1, VF2 and VF3. Each of the output voltages DV1, DV2 and DV3 includes a positive period and a negative period, which alternately arranged.

The output voltages DV1, DV2 and DV3 having the positive and negative periods are applied to the pixel rows, and each of the output voltages DV1, DV2 and DV3 may have different polarities every pixel row. The periods of the output voltages DV1, DV2 and DV3 may include a first period S1 and a second period S2, which are sequentially output.

In an exemplary embodiment, the first feedback voltage VF1 corresponds to the gate voltage, which is not delayed. Accordingly, the first output voltage DV1 may be a voltage, which is output when the undelayed gate voltage is feedback as the feedback voltage VF. When the high period of the first feedback voltage VF1 begins, a voltage level of the first output voltage DV1 increases and the first period S1 starts. When the high period of the first feedback voltage VF1 is finished, the first period S1 is finished. In this case, a timing difference may occur between the high period of the first feedback voltage VF1 and the first period S1 of the first output voltage DV1 due to a response time of a device.

The pixel PX (refer to FIG. 1) is charged with the data voltage corresponding to the first period S1 during the high period of the gate voltage. That is, the high period of the gate voltage is set to overlap with the first period S1 of the first output voltage DV1, and thus a grayscale voltage appropriate to a corresponding pixel is sufficiently applied to the corresponding pixel.

Different from the first feedback voltage VF1, the second and third feedback voltages VF2 and VF3 correspond to the delayed gate voltages. Each of the second and third feedback voltages VF2 and VF3 takes a long time to reach the high and low levels when compared with the first feedback voltage VF1.

When a time duration from a time point at which the voltage level of the feedback voltage VF increases from the low level to a high level to a time point at which the voltage level of the feedback voltage VF reaches to the low level is referred to as the high period of the feedback voltage VF, a width of the high period of the feedback voltage VF corresponding to the gate voltage becomes wider as the degree of delay of the gate voltage increases. In an exemplary embodiment, the width of the high period of the first to third feedback voltages VF1, VF2 and VF3 sequentially increases in order of the first to third feedback voltages VF1, VF2 and VF3.

As shown in FIG. 3, a period in which the first period S1 of the first output voltage DV1 overlaps the high period of each of the second feedback voltage VF2 and the third feedback voltage VF3 is shorter than a period in which the first period S1 of the first output voltage DV1 overlaps the first feedback voltage VF1.

Thus, when the output timing of the output voltage DV is not controlled while the second feedback voltage VF2 or the third feedback voltage VF3 is applied, the corresponding pixel is turned off before the corresponding pixel is effectively charged with the voltage to display the grayscale. That is, the voltage charged in the corresponding pixel is insufficient to display the grayscale, and as a result, the display device may not display desired image information or displays distorted image information.

According to an exemplary embodiment, the data driver 300 controls the output timing of the output voltage DV based on the feedback voltage VF applied thereto. When the first feedback voltage VF1, which is not delayed, is input, the first output voltage DV1 is output at a predetermined output timing thereof without controlling or changing the output timing of the first output voltage DV1, and when the second feedback voltage VF2 or the third feedback voltage VF3, which is delayed, is input, the second and third output voltages DV2 and DV3 are output at the output timing delayed than the predetermined output timing Thereof.

The second output voltage DV2 is output after being delayed by a first delay time t1 than the first output voltage DV1, and the third output voltage DV3 is output after being delayed by a second delay time t2 than the first output voltage DV1. That is, based on delays in the second and third feedback voltages VF2 and VF3, the second and third output voltages DV2 and DV3 are output after being delayed based on the delay of the gate voltage corresponding thereto, e.g., by taking the degree of delay of the gate voltage corresponding thereto into consideration.

When the second output voltage DV2 is output after being delayed by the first delay time t1 than the first output voltage DV1, the second output voltage DV2 is effectively matched with the second feedback voltage VF2, that is, the second output voltage DV2 is delayed to allow the starting point of the first output voltage DV1 to be the time point at which the voltage level of the feedback voltage VF2 is in the high level. In a similar manner, when the third output voltage DV3 is output after being delayed by the second delay time t2 than the first output voltage DV1, the third output voltage DV3 is effectively matched with the third feedback voltage VF3.

Therefore, since the gate voltage maintains the turn-on state during the first period S1, each of the first to third output voltages DV1, DV2, and DV3 is sufficiently charged in the corresponding pixel. In an exemplary embodiment, the display device delays the output timing of the data voltage based on the degree of delay of the gate voltage in response to the gate voltage feedback thereto. Therefore, in such an embodiment, the gate voltage is effectively synchronized with the corresponding data voltage and the image information displayed in the display device is effectively prevented from being distorted.

In an alternative exemplary embodiment, the first, second and third feedback voltages VF1, VF2 and VF3 may be provided through different feedback lines. In such an embodiment, the first, second, and third feedback voltages VF1, VF2 and VF3 include delay information about the gate voltages flowing through different gate lines in one frame period.

In such an embodiment, the output voltages DV1, DV2 and DV3 may be the data voltages applied to different pixel rows in one frame period. In such an embodiment of the display device may control the output timing of the data voltage every pixel row in real time.

According to an exemplary embodiment, as described above, the first, second and third feedback voltages VF1, VF2 and VF3 may be feedback voltages provided through one feedback line. In such an embodiment, the first, second, and third feedback voltages VF1, VF2 and VF3 include the delay information about the gate voltage flowing through one gate line, which is delayed as time passes.

Therefore, the output voltages DV1, DV2 and DV3 may be the data voltages applied to the display panel 100 at different timings from each other. According to exemplary embodiments as described above, the display device may control the output timing of the data voltage in real time to correspond to the variation in the gate voltage due to the usage thereof.

Figure 4A:
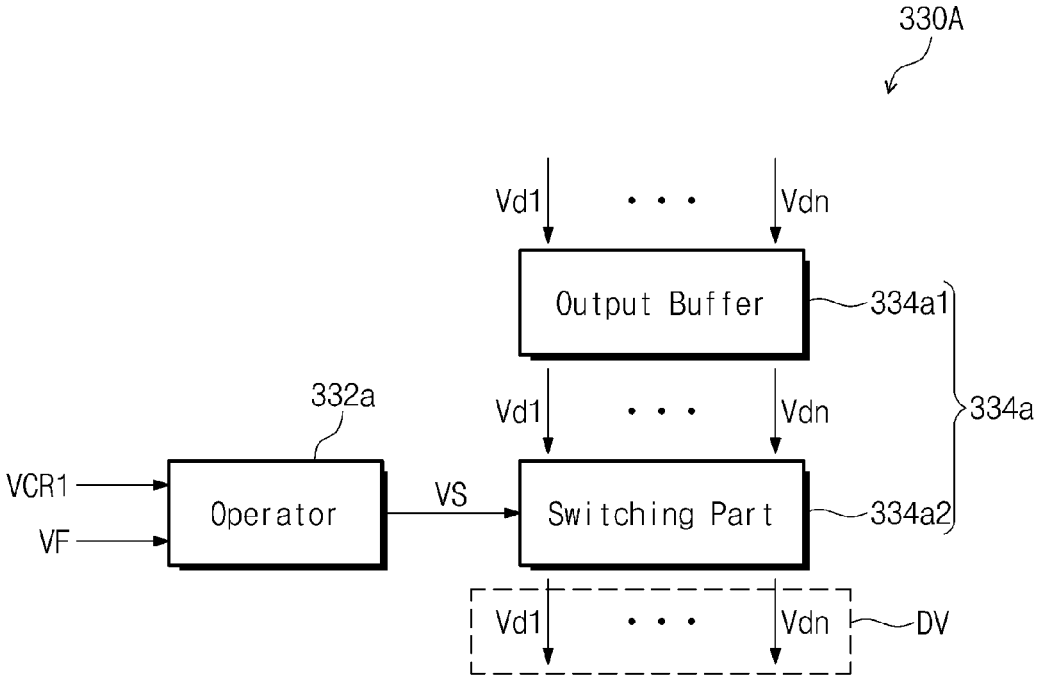
FIG. 4A is a block diagram showing an exemplary embodiment of an output part according to the invention.
Figure 4B:
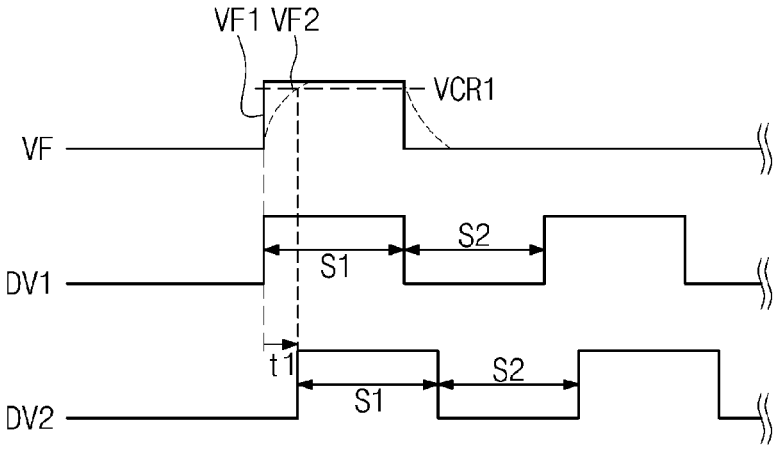
FIG. 4B is a signal timing diagram showing a feedback voltage input to the output part and an output voltage output from the output part shown in FIG. 4A.

FIG. 4A is a block diagram showing an exemplary embodiment of an output part 330A according to the invention, and FIG. 4B is a signal timing diagram showing a feedback voltage input to the output part and data voltages output from the output part shown in FIG. 4A.

As shown in FIG. 4A, an exemplary embodiment of the output part 330A includes an operator 332*a* and an output timing determining part 334*a*. The output timing determining part 334*a* includes an output buffer 334*a*1 and a switching part 334*a*2.

The operator 332*a* receives the feedback voltage VF and a predetermined reference voltage VCR1, and outputs a switching voltage VS. The switching voltage VS may be, but not limited to, a timing compensation voltage.

The operator 332*a* may include various circuits. In one exemplary embodiment, for example, the operator 332*a* may be a comparator having the reference voltage VCR1 as a reference voltage thereof.

The operator 332*a* receives the feedback voltage VF, compares the feedback voltage VF with the reference voltage VCR1, and outputs the switching voltage VS based on a result of the comparison. The operator 332*a* outputs the switching voltage VS when the feedback voltage VF has a voltage level greater than that of the reference voltage VCR1.

The reference voltage VCR1 has a predetermined voltage level having a voltage levels equal to or greater than the low level of the feedback voltage VF and equal to or lower than the high level of the feedback voltage VF. The reference voltage VCR1 may have a voltage level that indicates that the feedback voltage VF sufficiently reaches the high level. In one exemplary embodiment, for instance, the reference voltage VCR1 may be set to have the voltage level corresponding to about 85% of the high level of the feedback voltage VF, and the operator 332*a* outputs the switching voltage VS when the voltage level of the feedback voltage VF reaches to the voltage level of the reference voltage VCR1.

The output buffer 334*a*1 receives the data voltages Vd1 to Vdn from an external source and buffers the data voltages Vd1 to Vdn. The switching part 334*a*2 controls an output timing of the data voltages Vd1 to Vdn output from the output buffer 334*a*1.

The switching voltage VS is applied to the switching part 334*a*2. The switching part 334*a*2 includes a plurality of switching devices (not shown). The switching devices are connected to the data lines DL1 to DLn (refer to FIG. 1) disposed in the display panel 100 (refer to FIG. 1), respectively.

The switching part 334*a*2 is turned on in response to the switching voltage VS applied thereto and outputs the output voltage DV to the display panel 100. Thus, the switching part 334*a*2 controls the output timing of the data voltage DV such that the output voltage DV is output at a time point at which the voltage level of the feedback voltage VF1 becomes greater than about the voltage level of the reference voltage VCR1.

FIG. 4B shows timings of the feedback voltages VF1 and VF2 and timings of the output voltages DV1 and DV2, which are controlled in response to the feedback voltages VF1 and VF2. The feedback voltages VF1 and VF2 may include a first feedback voltage VF1 corresponding to an undelayed gate voltage and a second feedback voltage VF2 corresponding to a delayed gate voltage.

In an exemplary embodiment, as shown in FIG. 4B, the output timing of the output voltages DV1 and DV2 is adjusted such that the output voltages DV1 and DV2 are output at the time point at which the voltage level of the feedback voltages VF1 and VF2 becomes greater than about the voltage level of the predetermined reference voltage VCR1. The first feedback voltage VF1 is a feedback voltage that reaches to the high level without being delayed. Therefore, the first output voltage DV1 is output at a time point at which the high period of the first feedback voltage VF1 begins.

Different from the first feedback voltage VF1, the second feedback voltage VF2 may be a gate voltage, which is more delayed than the gate voltage corresponding to the first feedback voltage VF1, that is, the second feedback voltage VF2 may take a long time to reach the high level when compared with the first feedback voltage VF1. Thus, when compared with the output timing of the first output voltage DV1, the output timing of the second output voltage DV2 is delayed by a predetermined delay time t1. Accordingly, the data driver 300 (refer to FIG. 1) receives the feedback information about the gate voltage from the display panel 100 (refer to FIG. 1) and outputs the data voltages in real time by taking the degree of delay of the gate voltages into consideration.

Figure 5A:
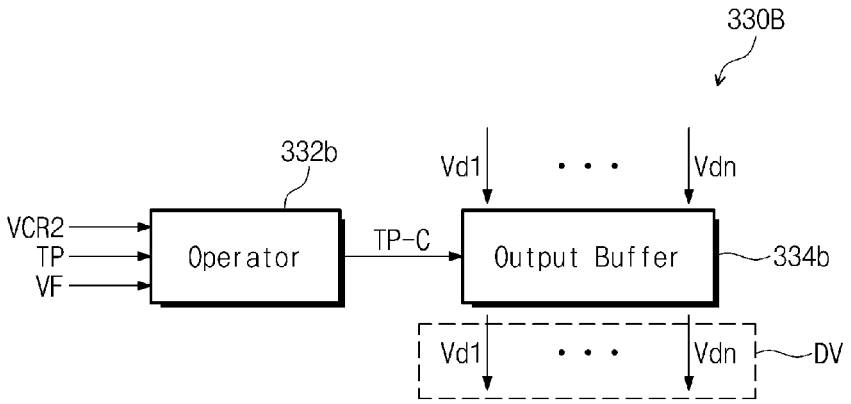
FIG. 5A is a block diagram showing an alternative exemplary embodiment of an output part according to the invention.
Figure 5B:
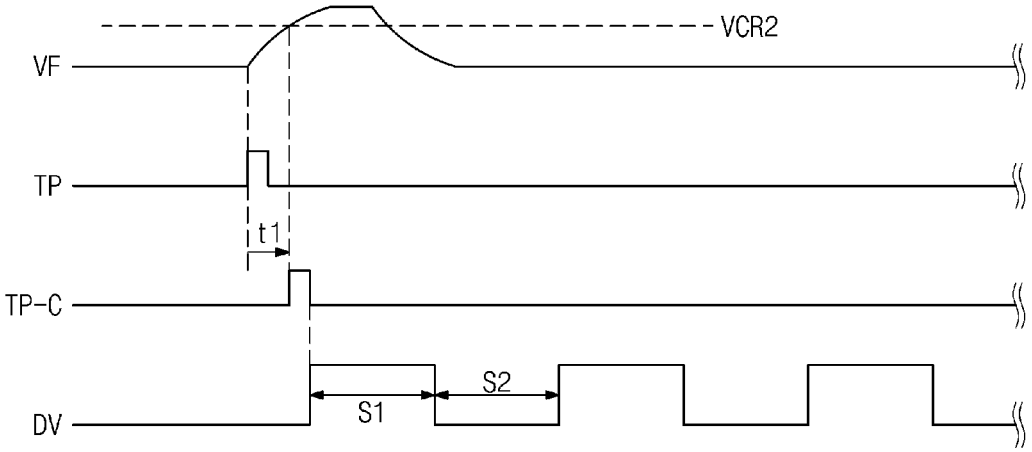
FIG. 5B is a signal timing diagram showing a feedback voltage input to the output part and an output voltage output from the output part shown in FIG. 5A.

FIG. 5A is a block diagram showing an alternative exemplary embodiment of an output part 330B according to the invention, and FIG. 5B is a signal timing diagram showing a feedback voltage input to the output part 330B and data voltages output from the output part 330B shown in FIG. 5.

In an exemplary embodiment, as shown in FIG. 5A, the output part 330B includes an operator 332*b* and an output buffer 334*b*. FIG. 5B shows timings of the feedback voltage VF, an output start signal TP, a compensated output start signal TP-C, and the output voltage DV. In FIGS. 5A and 5B, the same reference numerals denote the same elements in FIGS. 4A and 4B, and any repetitive detailed descriptions of the same elements will be omitted or simplified.

Referring to FIGS. 5A and 5B, the operator 332*b* receives the feedback voltage VF, a reference voltage VCR2 and the output start signal TP. An output timing of the output start signal TP may be determined based on initial setting information. Accordingly, the output start signal TP may be set to be output at a time point at which the high period of the feedback voltage VF begins, i.e., at a time point at which the voltage level of the feedback voltage VF starts to increase.

The reference voltage VCR2 has a predetermined voltage level, which is preset to be higher than the low level of the feedback voltage VF and lower than the high level of the feedback voltage VF. The reference voltage VCR2 may be set to have different voltage levels based on a structure of the display panel and a usage environment of the display panel. The reference voltage VCR2 has the voltage level, which indicates that the feedback voltage VF sufficiently reaches the high level, but not being limited to a specific voltage level.

The operator 332*b* compensates the output start signal TP in response to the feedback voltage VF, and outputs the compensated output start signal TP-C. The compensated output start signal TP-C may be, but not limited to, a timing compensation voltage generated to determine the output timing of the output voltage DV.

The compensated output start signal TP-C is output when the feedback voltage VF reaches the voltage level equal to or greater than the reference voltage VCR2. Therefore, the compensated output start signal TP-C is output at a time point at which the feedback voltage VF substantially reaches the high level rather than a time point at which the feedback voltage VF is output.

In an exemplary embodiment, the compensated output start signal TP-C may have substantially the same voltage level as that of the output start signal TP, and only the output timing thereof may be adjusted. In an exemplary embodiment, the compensated output start signal TP-C is output after being delayed by a predetermined time t1 than the output start signal TP.

The output buffer 334*b* controls the output timing of the output voltage DV in response to the compensated output start signal TP-C. The output buffer 334*b* outputs the output voltage DV in response to the compensated output start signal TP-C. Accordingly, the output timing of the output voltage DV is delayed to the time point at which the feedback voltage VF has the voltage level greater than that of the reference voltage VCR2.

When the gate voltage corresponding to the feedback voltage VF is delayed, it takes time for the gate voltage or the feedback voltage VF to reach the high period. Accordingly, when the gate voltage corresponding to the feedback voltage VF is delayed, the output start signal TP is adjusted to correspond to the delay information about the gate voltages, and thus the data voltages Vd1 to Vdn are effectively prevented from remaining in corresponding pixels without driving the corresponding pixels. In such an embodiment, the output timing of the output voltage DV is controlled, such that the data voltages are sufficiently charged in the corresponding pixels in a short period of time, and the pixels may be effectively prevented from being undercharged.

In an exemplary embodiment, when a falling time of the feedback voltage VF is delayed due to increase of the degree of delay of the feedback voltage VF, the high period of the feedback voltage VF overlaps the second period S2 of the output voltage DV, which follows the first period S1. In an exemplary embodiment, as described above, the data voltages are applied to different pixel rows from each other during the first period S1 and the second period S2. In an exemplary embodiment, the display device controls the output timing of the output voltage DV based on the degree of delay of the feedback voltage VF, and thus the data voltage of the second period S2 is effectively charged.

Figure 6:
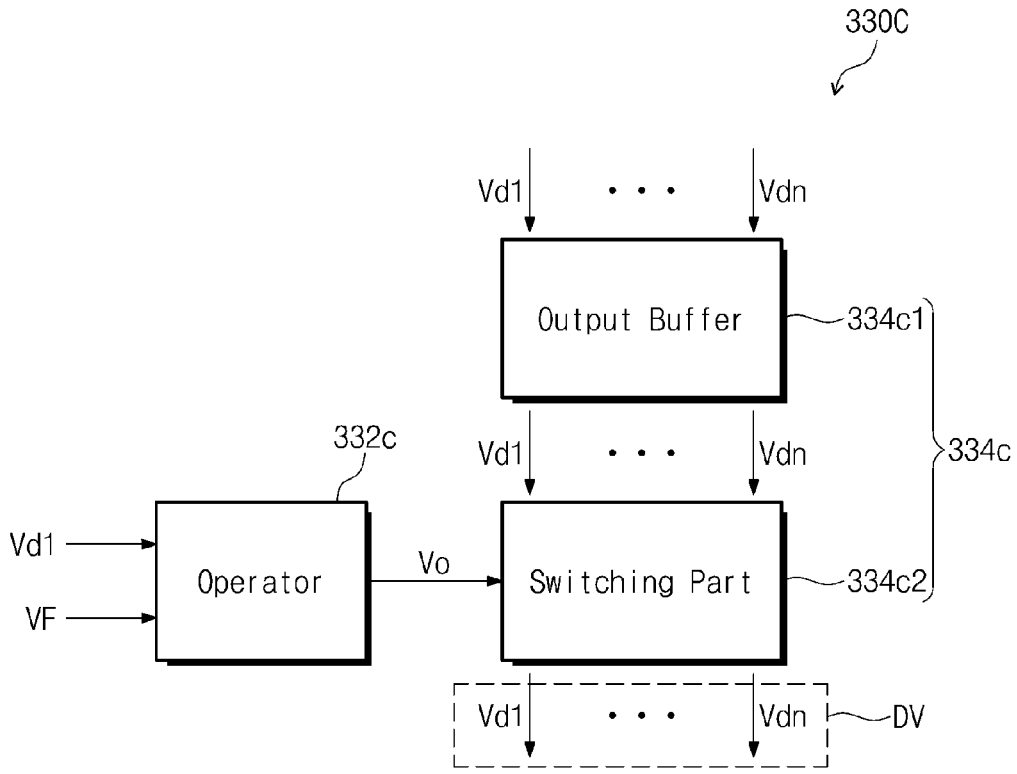
FIG. 6 is a block diagram showing another alternative exemplary embodiment of an output part according to the invention.
Figure 7:
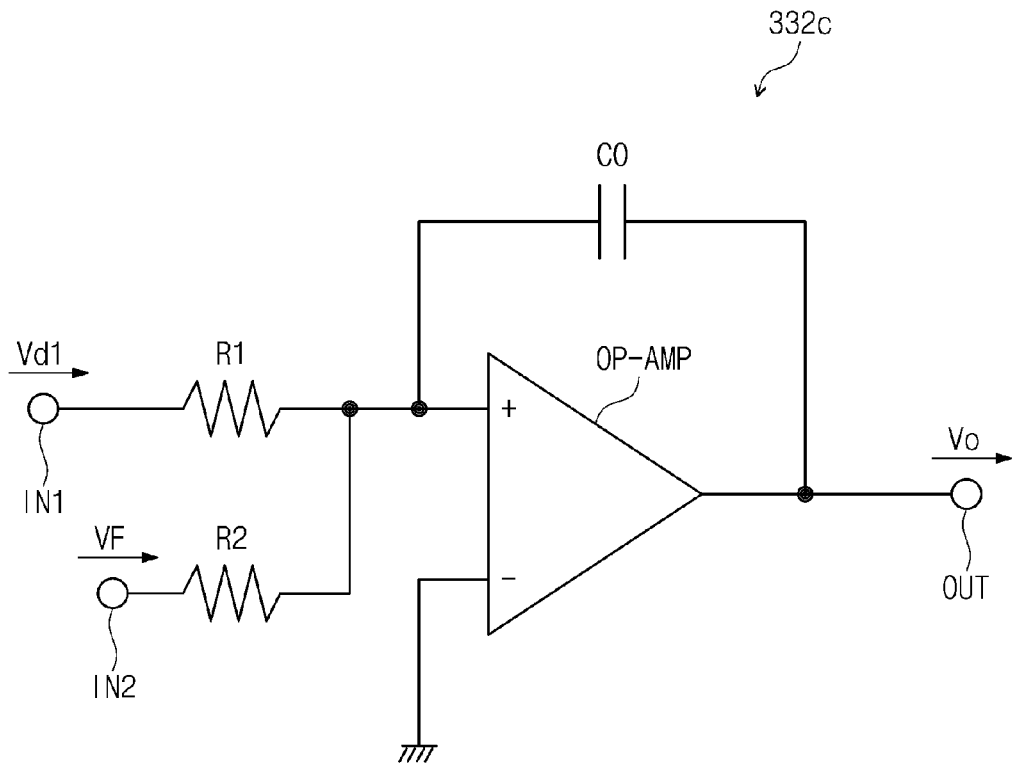
FIG. 7 is a circuit diagram showing an exemplary embodiment of an operator shown in FIG. 6.

FIG. 6 is a block diagram showing another alternative exemplary embodiment of an output part 330C according to the invention, and FIG. 7 is a circuit diagram showing an exemplary embodiment of an operator 332*c* shown in FIG. 6.

Referring to FIG. 6, an exemplary embodiment of the output part 330C includes an operator 332*c*, an output buffer 334*c*1, and a switching part 334*c*2. The output part 330C shown in FIG. 6 has substantially the same structure and function as those of the output part 330A shown in FIG. 4A except for the operator 332*c*.

In an exemplary embodiment, the operator 332*c* may further receive at least one data voltage of the data voltages in addition to the feedback voltage VF. The operator 332*c* receives the first data voltage Vd1 and the feedback voltage VF and outputs a timing compensation voltage Vo. In one exemplary embodiment, for example, the operator 332*c* may receive the first data voltage Vd1 applied to the first pixel column, but not being limited thereto.

In an exemplary embodiment, the data voltages Vd1 to Vdn are substantially simultaneously output. Therefore, the output timing of the data voltages Vd1 to Vdn may be determined based on the output timing of one of the data voltages Vd1 to Vdn, but not being limited thereto or thereby. In an exemplary embodiment, the display device may sequentially output the data voltages. In such an embodiment, the operator 332*c* may control the output timing of a data voltage that is firstly output, and the output timings of other data voltages are sequentially controlled based on the output timing of the first output data voltage.

Referring to FIG. 7, an exemplary embodiment of the operator 332*c* includes an integrating amplifier circuit. The integrating amplifier circuit includes an operational amplifier OP-AMP, a first resistor R1 disposed (or connected) between a non-inverting terminal of the operational amplifier OP-AMP and a first input terminal IN1, a second resistor R2 disposed (or connected) between the non-inverting terminal and a second input terminal IN2, and a capacitor CO disposed (or connected) between the non-inverting terminal and an output terminal OUT of the operational amplifier OP-AMP.

The first input terminal IN1 receives the first data voltage Vd1 and the second input terminal IN2 receives the feedback voltage VF. An inverting terminal of the operational amplifier OP-AMP is applied with a ground voltage.

The timing compensation voltage Vo is output from the output terminal OUT. The integrating amplifier circuit is designed to operate the first data voltage Vd1 and the feedback voltage VF according to the following Equation 1, and outputs the timing compensation voltage Vo according to a result of the operation.

$$Vo = -\left(\frac{1}{Co \cdot R1}\int_{T1}^{T2} VF\,dt + \frac{1}{Co \cdot R2}\int_{T1}^{T2} Vd1\,dt\right) \qquad \text{Equation 1}$$

As shown in Equation 1, the integrating amplifier circuit integrates the first data voltage Vd1 and the feedback voltage VF, which are applied thereto, during a predetermined time, e.g., from a first time point to a second time point T1-T2. The integrated result value is output as the timing compensation voltage Vo and applied to the switching part 334*c*2.

In an exemplary embodiment, the predetermined time T1-T2 partially corresponds to the period of the first data voltage Vd1 input to the second input terminal IN2. In one exemplary embodiment, for example, the predetermined time T1-T2 corresponds to the first period S1 (refer to FIG. 4B) of the first output voltage DV1 shown in FIG. 3B.

The first data voltage Vd1 may be continuously varied while being applied to the second input terminal IN2. The timing compensation voltage Vo may be a value determined based on a matching degree between the feedback voltage VF and the first data voltage Vd1 during the predetermined time T1-T2.

In an exemplary embodiment, the timing compensation voltage Vo is substantially proportional to the matching degree. The timing compensation voltage Vo may serve as a factor to figure out the matching degree between the feedback voltage VF and the first data voltage Vd1, which depends on the output timing of the first data voltage Vd1.

In one exemplary embodiment, for example, as the output timing of the first data voltage Vd1 is delayed to match the output timing of the first data voltage Vd1 with the feedback voltage VF, the timing compensation voltage Vo increases, and then the timing compensation voltage Vo decreases after the output timing of the first data voltage Vd1 reaches an optimal output timing thereof. Accordingly, the timing compensation voltage Vo has a maximum value when the first data voltage Vd1 having the optimal output timing optimized with the feedback voltage VF is input.

The switching part 334*c*2 is turned on or turned off based on the voltage level of the timing compensation voltage Vo. The switching part 334*c*2 is turned on when the timing compensation voltage Vo has the voltage level greater than a predetermined threshold value and outputs the output voltage DV. The threshold value includes the maximum value, and the threshold value may have a value obtained by integrating the first data voltage Vd1 having a fastest output timing, during which the data voltages are charged in the corresponding pixels in response to the gate voltages, and the corresponding feedback voltage VF.

In an exemplary embodiment, the display device includes the output part 330C and generates the timing compensation voltage Vo in consideration of the information about the data voltages Vd1 to Vdn in addition to the information about the corresponding gate voltage. In such an embodiment, the timing compensation voltage Vo is determined based on the data voltages Vd1 to Vdn to optimize the output timing of the output voltage DV.

Although the exemplary embodiments of the invention have been described herein, it is understood that the invention should not be limited to these exemplary embodiments but various changes and modifications can be made by one ordinary skilled in the art within the spirit and scope of the invention as hereinafter claimed.

What is claimed is:

1. A display device comprising:

a display panel comprising:

a plurality of pixels;

a plurality of gate lines electrically connected to the pixels; and a plurality of data lines electrically connected to the pixels;

a gate driver which sequentially applies gate voltages to the gate lines;

a data driver which receives at least a portion of the gate voltages applied to the gate lines as a feedback voltage, determines an output timing of data voltages based on the feedback voltage, and outputs the data voltages to the data lines, respectively, based on the output timing; and a feedback line directly connected to at least one of the gate lines to apply the feedback voltage to the data driver.

2. The display device of claim 1, wherein the gate lines comprise first to m-th gate lines arranged in a scan direction, and the feedback line is connected to the m-th gate line.

3. The display device of claim 1, wherein the feedback line comprises a plurality of feedback lines, the feedback lines are connected to different gate lines of the gate lines, respectively, a plurality of feedback voltages are applied to the data driver through the feedback lines, and the data driver controls the output timing of the data voltages to every corresponding pixel row connected to the feedback lines through the different gate lines based on the feedback voltages in real time.

4. The display device of claim 1, wherein the data driver comprises:

an input part which receives image data signals in a digital form from an outside thereof;

a converter which converts the image data signals applied from the input part into the data voltages in an analog form; and an output part which controls the output timing of the data voltages based on the feedback voltage and outputs the data voltages to the display panel.

5. The display device of claim 4, wherein the output part comprises:

an operator which receives the feedback voltage and outputs a timing compensation voltage determined based on the feedback voltage; and a timing determining part which determines the output timing of the data voltages based on the timing compensation voltage.

6. The display device of claim 5, wherein the timing determining part comprises:

an output buffer which receives the data voltages from the converter and buffers the data voltages; and a switching part which receives the timing compensation voltage and controls the output timing of the data voltages based on the timing compensation voltage.

7. The display device of claim 6, wherein the switching part comprises a plurality of switching devices connected to the data lines, respectively.

8. The display device of claim 7, wherein the operator receives at least one data voltage of the data voltages output from the output buffer, and the operator operates the data voltage and the feedback voltage to generate the timing compensation voltage.

9. The display device of claim 8, wherein the operator comprises an integrating amplifier circuit.

10. The display device of claim 5, wherein the operator receives an output start signal from an outside thereof and outputs the output start signal compensated to correspond to the feedback voltage as the timing compensation voltage, and the timing determining part outputs the data voltages to the display panel based on the timing compensation voltage.

* * * * *